US010456695B1

(12) United States Patent
Henley

(10) Patent No.: US 10,456,695 B1
(45) Date of Patent: Oct. 29, 2019

(54) AMUSEMENT APPARATUS, COMPONENTS, AND METHOD

(71) Applicant: Darrell M. Henley, Springfield, MO (US)

(72) Inventor: Darrell M. Henley, Springfield, MO (US)

( * ) Notice: Subject to any disclaimer, the term of this patent is extended or adjusted under 35 U.S.C. 154(b) by 0 days.

(21) Appl. No.: 15/973,726

(22) Filed: May 8, 2018

Related U.S. Application Data

(63) Continuation-in-part of application No. 15/890,734, filed on Feb. 7, 2018, now abandoned.

(60) Provisional application No. 62/455,786, filed on Feb. 7, 2017.

(51) Int. Cl.
*A63G 31/08* (2006.01)
*A63G 9/00* (2006.01)

(52) U.S. Cl.
CPC ..... *A63G 31/08* (2013.01)

(58) Field of Classification Search
CPC ... A63G 9/00; A63G 9/08; A63G 9/16; A63G 27/00; A63G 27/02; A63G 27/04; A63G 31/00; A63G 31/08; E04H 4/00
USPC ..... 472/44, 47, 119, 125
See application file for complete search history.

(56) References Cited

U.S. PATENT DOCUMENTS

| | | | | |
|---|---|---|---|---|
| 758,579 | A | 4/1904 | Armstrong | A63G 9/00 |
| 1,215,110 | A | 2/1917 | Carey | A63G 9/16 |
| 1,469,910 | A | 10/1923 | Jacobs | A63G 9/16 |
| 2,076,113 | A | 4/1937 | Bartlett | A63G 9/16 |
| 2,222,119 | A | 11/1940 | Overholt | A63G 9/00 |
| 2,562,324 | A | 7/1951 | McBride | A63G 9/08 |
| 2,828,128 | A | 3/1958 | Castille | A63G 27/02 |
| 3,692,305 | A | 9/1972 | Allen | A63G 9/16 |
| 3,707,282 | A | 12/1972 | Robinson | A63G 27/04 |
| 3,778,054 | A | 12/1973 | Esposito, Jr. | A63G 9/00 |
| 3,883,136 | A | 5/1975 | Kim | A47D 13/109 |
| 3,904,194 | A | 9/1975 | Schwarzkopf | A63G 1/44 |
| 4,007,926 | A | 2/1977 | Ottaway | A63G 4/00 |
| 4,036,489 | A * | 7/1977 | Potyondy | A63G 9/08 472/118 |
| 4,229,000 | A | 10/1980 | Scherling | A63B 5/10 |
| 4,805,902 | A | 2/1989 | Casagrande | A47D 13/105 |
| 4,986,600 | A | 1/1991 | Leblanc et al. | B60N 2/3084 |
| 5,046,719 | A | 9/1991 | Comstock et al. | A63G 31/00 |
| 5,100,199 | A | 3/1992 | Vander Stel et al. | A61K 31/155 |
| 5,224,756 | A | 7/1993 | Dukatz et al. | B60N 2/3084 |
| 5,267,906 | A | 12/1993 | Kitchen et al. | A63G 9/00 |
| 5,366,270 | A | 11/1994 | Heussner et al. | B60N 2/2878 |
| 5,385,384 | A | 1/1995 | Gierman et al. | B60N 2/3084 |
| RE34,868 | E | 2/1995 | Vander Stel et al. | B60N 2/3084 |

(Continued)

FOREIGN PATENT DOCUMENTS

| | | | |
|---|---|---|---|
| EP | 2762214 A1 | 8/2014 | A63G 27/04 |

*Primary Examiner* — Kien T Nguyen
(74) *Attorney, Agent, or Firm* — Jonathan A. Bay

(57) ABSTRACT

An amusement ride for locating on a ground leading to a ledge of a drop off has a pair of rocking boom, an axle, spokes and a passenger carrier. The pair of rocking booms are pivotally mounted near the ledge of the drop off. The axle is carried between the ends of rocking booms and when the rocking booms are tilted outboard of the ledge, the axle is suspended out over the empty space past the drop off. The spokes extending radially away from the axle to connections with the carrier. The axle is driven by a drive system to swing the carrier, from large arcs to full 360° revolutions.

20 Claims, 12 Drawing Sheets

(56) References Cited

U.S. PATENT DOCUMENTS

| | | | | |
|---|---|---|---|---|
| 5,466,043 | A | 8/1995 | Crawley et al. | C07D 213/30 |
| 5,449,216 | A | 9/1995 | Geirman et al. | B60N 2/3084 |
| 5,472,260 | A | 12/1995 | Czapski et al. | B60N 2/3084 |
| 5,474,357 | A | 12/1995 | Dukatz et al. | B60N 2/3084 |
| 5,498,062 | A | 3/1996 | Holdampf | B60N 2/3084 |
| 5,527,223 | A | 6/1996 | Kitchen et al. | A47D 9/00 |
| 5,564,780 | A | 10/1996 | Presser et al. | B60N 2/2878 |
| 5,573,465 | A | 11/1996 | Kitchen et al. | A63G 9/00 |
| 5,588,700 | A | 12/1996 | Homier | B60N 2/3084 |
| 5,647,634 | A | 7/1997 | Presser et al. | B60N 2/2878 |
| 5,649,866 | A | 7/1997 | Balwanz | A63G 9/00 |
| 5,658,201 | A | 8/1997 | Kleimeyer et al. | A63G 27/00 |
| 5,688,178 | A | 11/1997 | Emrie | A63G 1/38 |
| 5,782,699 | A | 7/1998 | Harrap | A63G 9/00 |
| 5,803,815 | A | 9/1998 | Kitchen | A63G 27/00 |
| 5,810,671 | A | 9/1998 | Balwanz et al. | A63G 31/08 |
| 5,827,124 | A | 10/1998 | Kleimeyer et al. | A63G 1/08 |
| 5,842,928 | A | 12/1998 | McGinnis | A63G 9/00 |
| 5,899,534 | A | 5/1999 | Gray | B60N 2/3084 |
| 5,931,740 | A | 8/1999 | Kitchen | A63G 9/12 |
| 5,957,779 | A | 9/1999 | Larson | A63G 1/44 |
| 5,960,488 | A * | 10/1999 | Morris | A61G 7/1005 4/496 |
| 5,989,127 | A | 11/1999 | Kitchen et al. | A63G 31/00 |
| 6,368,227 | B1 | 4/2002 | Olson | A63G 9/00 |
| 6,416,418 | B1 | 7/2002 | Kleimeyer | A63G 9/00 |
| 6,440,002 | B1 | 8/2002 | Jackson | A63G 9/00 |
| 6,511,381 | B1 | 1/2003 | Cochron | A63G 9/00 |
| 6,620,051 | B2 | 9/2003 | Kroon et al. | A63G 27/04 |
| 6,626,492 | B1 | 9/2003 | Uno | B60N 2/265 |
| 6,699,135 | B2 | 3/2004 | Cochron | A63G 9/00 |
| 6,808,459 | B2 | 10/2004 | Checketts | A63G 9/16 |
| 6,875,118 | B1 * | 4/2005 | Checketts | A63G 9/16 472/119 |
| 6,908,151 | B2 | 6/2005 | Meeker et al. | B60N 2/2806 |
| 7,066,822 | B2 | 6/2006 | Cochron | A63G 9/00 |
| 7,070,239 | B1 | 7/2006 | Ugrekhelidze et al. | B60N 2/3084 |
| 7,159,941 | B2 | 1/2007 | Thomas | B60N 2/2863 |
| 7,229,132 | B2 | 6/2007 | Meeker et al. | B60N 2/2806 |
| 7,547,066 | B2 | 6/2009 | Mendenhall | B60N 2/28 |
| 7,637,568 | B2 | 12/2009 | Meeker et al. | B60N 2/2806 |
| 7,744,476 | B2 | 6/2010 | Knijpstra | A63G 27/04 |
| 7,758,120 | B2 | 7/2010 | Zink et al. | B60N 2/2866 |
| 7,823,974 | B2 | 11/2010 | Mendenhall | B60N 2/2866 |
| 7,837,267 | B2 | 11/2010 | Zink et al. | B60N 2/2866 |
| 7,857,385 | B2 | 12/2010 | Zink et al. | B60N 2/2851 |
| 7,887,140 | B1 | 2/2011 | Forlivio | B60N 2/26 |
| 7,914,384 | B2 | 3/2011 | Roodenburg et al. | A63G 7/00 |
| 8,371,951 | B2 | 2/2013 | Nemeth et al. | A63G 1/28 |
| 8,684,853 | B2 | 4/2014 | Peters et al. | A63G 1/28 |
| 9,132,356 | B2 | 9/2015 | Giordano | A63G 9/00 |
| 9,199,178 | B2 * | 12/2015 | Knijpstra | A63G 27/04 |
| 9,272,223 | B2 | 3/2016 | Checketts | A63G 9/04 |
| 9,290,114 | B2 | 3/2016 | Herut | B60N 2/2878 |
| 2003/0017880 | A1 | 1/2003 | Kleimeyer | A63G 9/00 |
| 2004/0077415 | A1 | 4/2004 | Kleimeyer | A63G 7/00 |
| 2004/0192453 | A1 | 9/2004 | Esparza et al. | A63G 9/08 |
| 2006/0035715 | A1 | 2/2006 | Threlkel | A63G 9/00 |
| 2008/0143158 | A1 | 6/2008 | Roodenberg et al. | A63G 7/00 |
| 2010/0062868 | A1 | 3/2010 | Mordelt | A63J 5/12 |
| 2013/0085004 | A1 | 4/2013 | Thomas | A63G 9/00 |
| 2015/0232059 | A1 | 5/2015 | Zamperla | B60R 22/12 |
| 2016/0243451 | A1 | 8/2016 | Burger | A63G 7/00 |

* cited by examiner

AMUSEMENT APPARATUS, COMPONENTS, AND METHOD

CROSS-REFERENCE TO PROVISIONAL APPLICATION(S)

This application is a continuation-in-part of U.S. patent application Ser. No. 14/890,734, filed Feb. 7, 2018; which claims the benefit of U.S. Provisional Application No. 62/455,786, filed Feb. 7, 2017. The foregoing patent disclosure(s) is(are) incorporated herein by this reference thereto.

BACKGROUND AND SUMMARY OF THE INVENTION

The invention relates to amusement apparatus and, more particularly, to various rides or attractions including without limitation swings, Ferris wheels, base jumping (i.e., bungee jumping), bungee trampoline (with or without the trampoline) and so on.

It is an object of the invention to provide a pair of rocking booms mounted at the ledge of a drop off to suspend an amusement ride out over the empty space past the drop off.

It is a further object of the invention that such an amusement ride comprises for example and without limitation a swinging (passenger) carrier suspended from a swing axis extending between the distal ends of the rocking booms.

It is an alternative object of the invention to provide the above rocking booms with an angular degree of backwards tilting away from the ledge to pick-up passengers for the amusement ride at 'ground' level.

It is an additional object of the invention to configure the rocking booms (relative to spokes suspending the swinging carrier) such that the rocking booms can lift the swinging carrier over a safety barrier at the ledge of the drop off, and thereafter suspend the swinging carrier out into empty space past the drop off.

It is still another object of the invention to swing the swinging carrier. (when suspended out past the drop off) in full 360° rotations.

It is a further object of the invention to provide the swinging carrier with one or more passenger seats which can adapted for passengers ranging between children to large adults:—for example that is, between extremes of a thirty-six inch tall, thirty-five pound child (~1 m, 16 kg), and, an immense adult, perhaps exceeding four hundred and fifty pounds (~200 kg).

It is a corresponding object of the invention to achieve the foregoing with an array of different-sized inserts (e.g., booster seats).

It is yet another object of the invention that the rocking booms can tilt all the way backward to land on the 'ground,' or very close to the 'ground,' in order to bring the booms in closer to the 'ground' for maintenance and/or protection from extreme weather like high winds.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
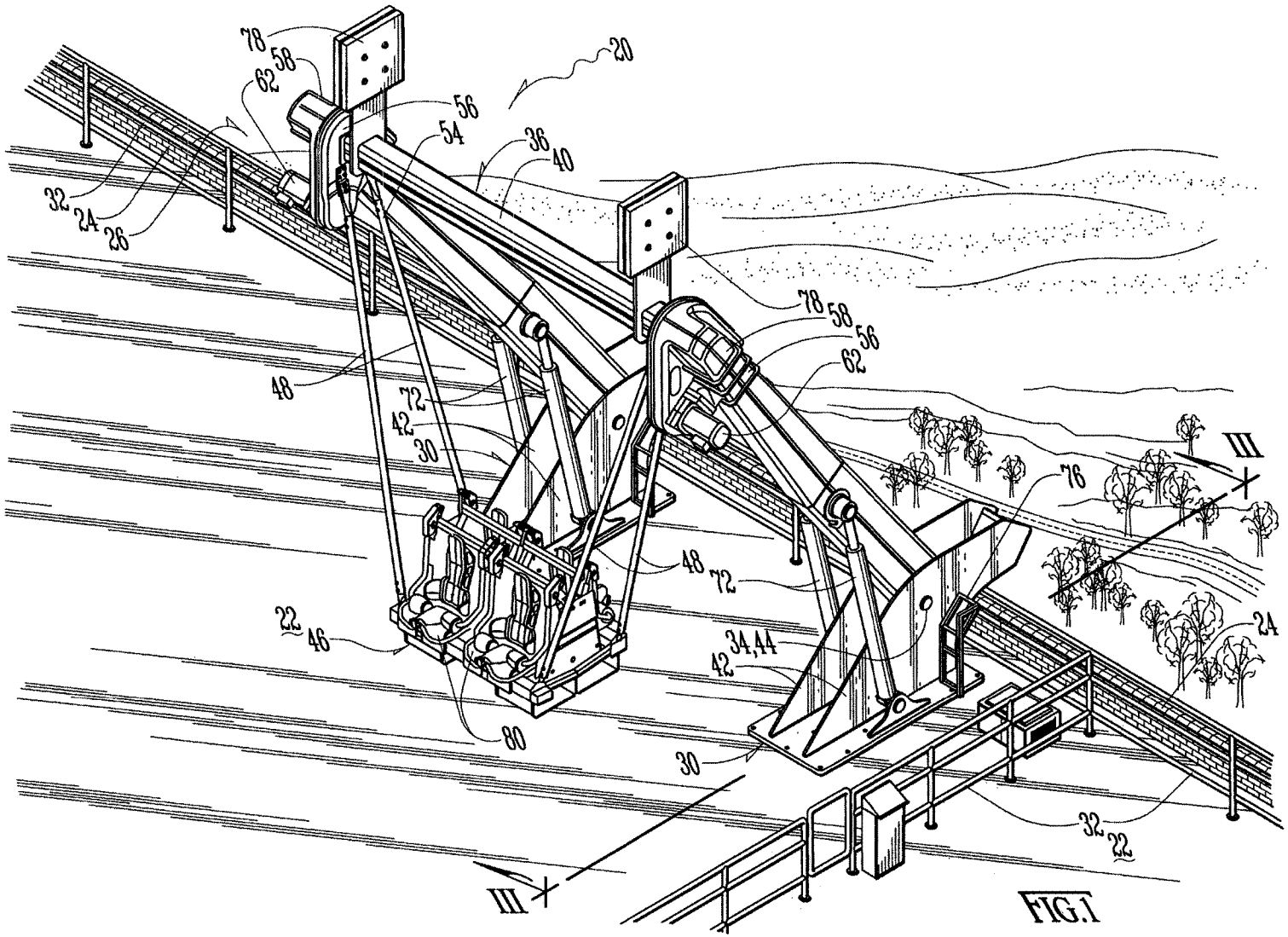
FIG. 1 is a perspective view of an exemplary embodiment of amusement apparatus, components, and method in accordance with the invention, wherein this exemplary embodiment comprises (for example and without limitation) a swing.
Figure 2:
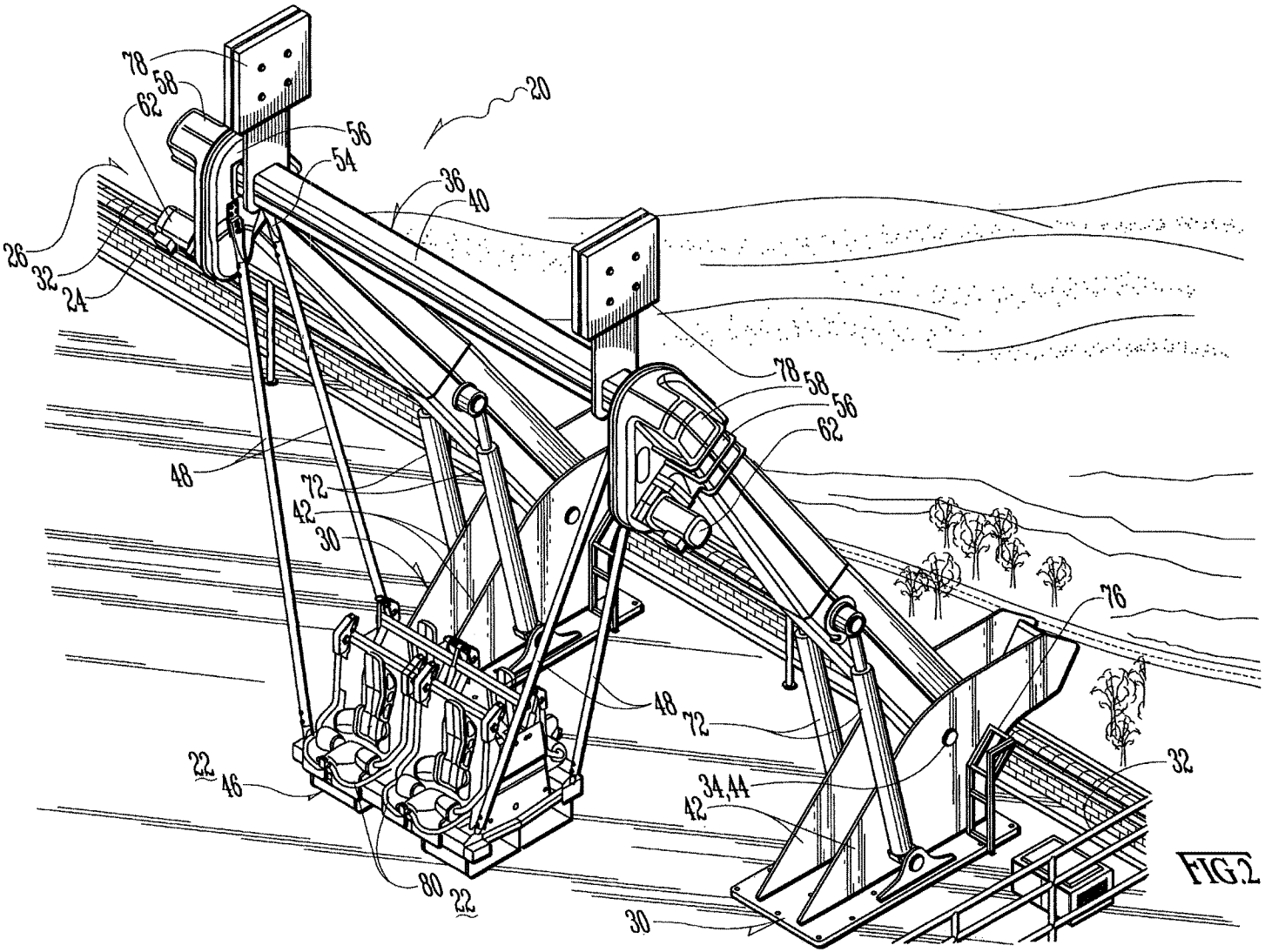
FIG. 2 is a perspective view comparable to FIG. 1 except on an enlarged scale.
Figure 3:
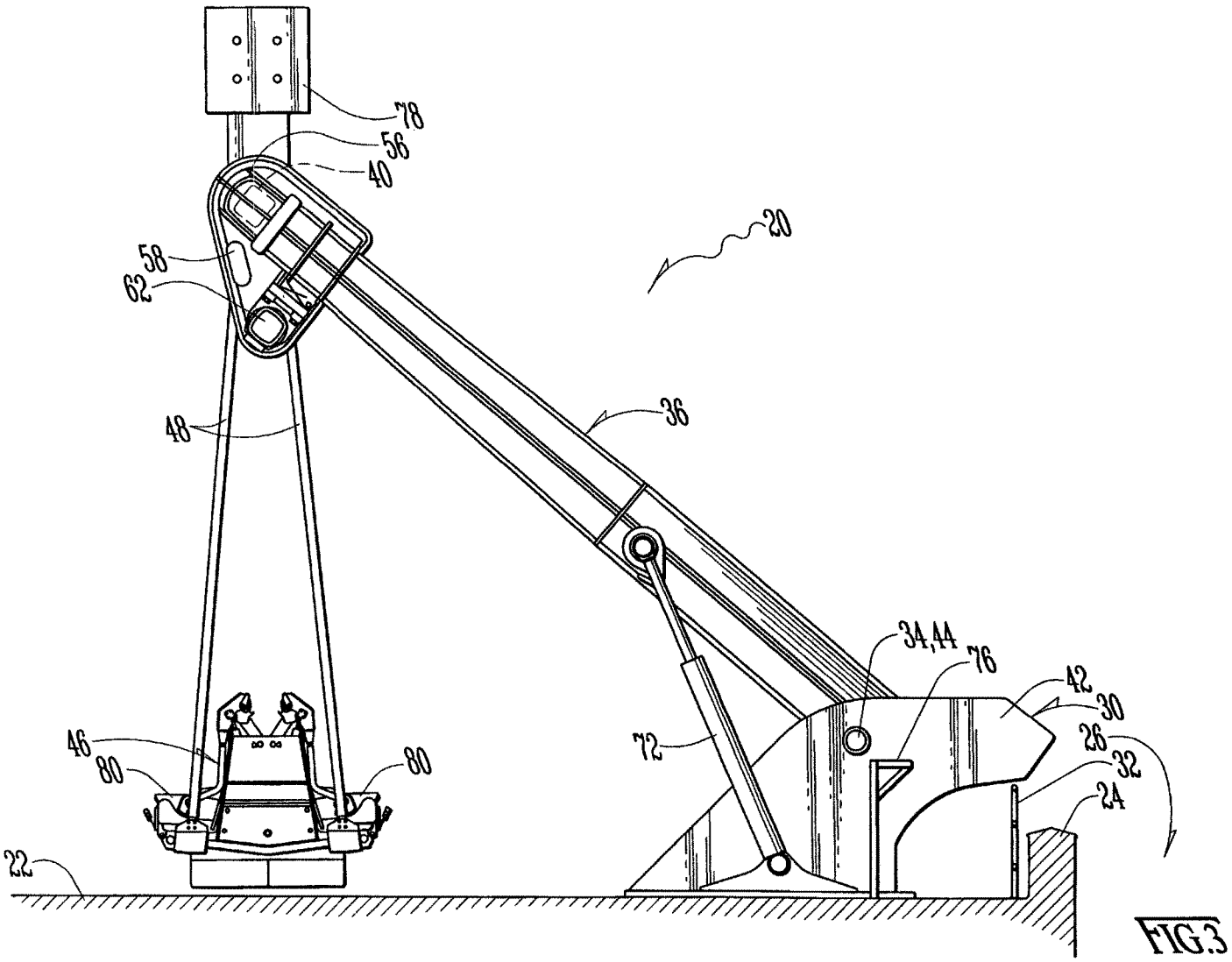
FIG. 3 is a side elevational view of FIG. 2.
Figure 4:
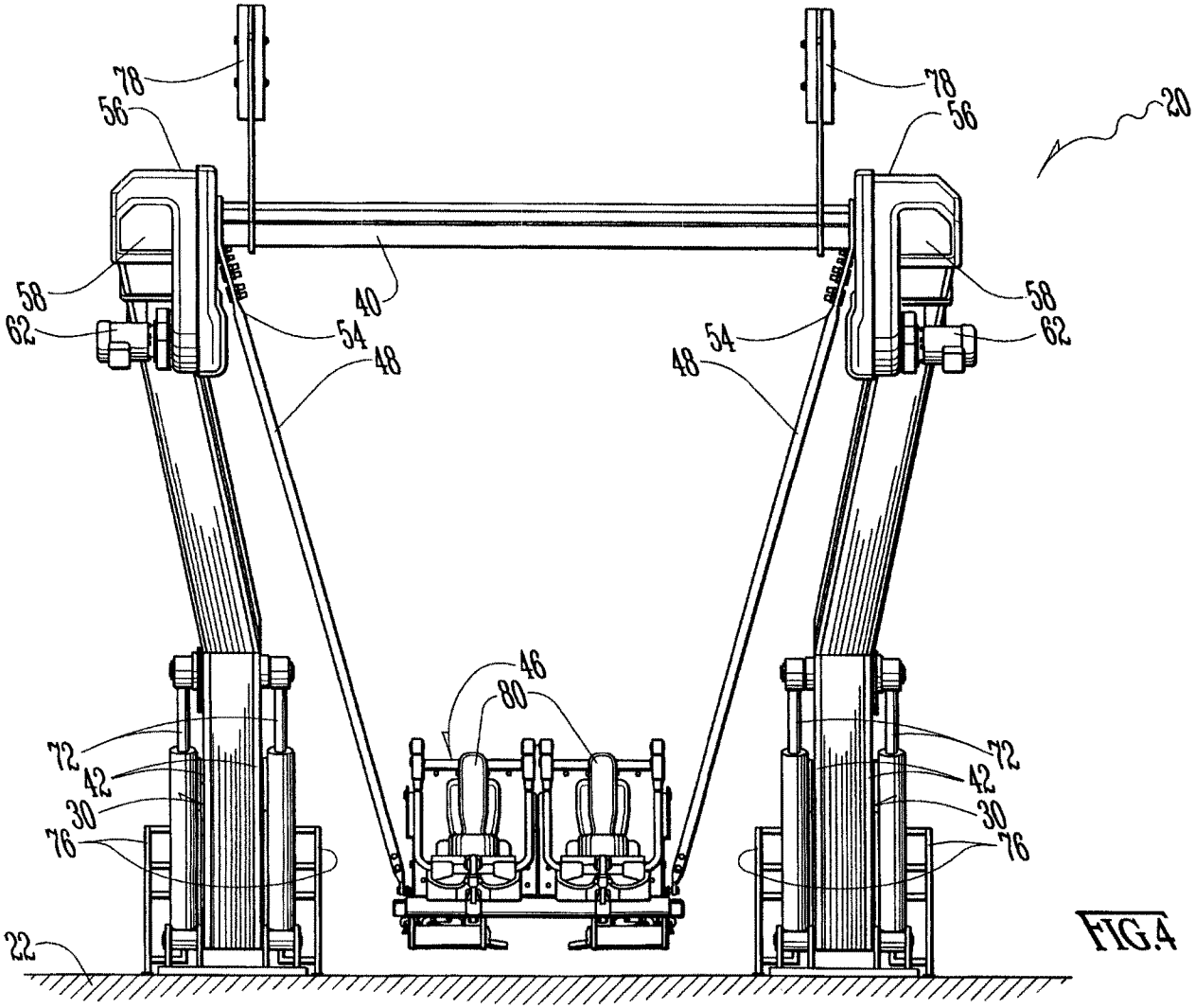
FIG. 4 is a rear elevational view of FIG. 3.

The drawings show an amusement ride 20 in accordance with the invention advantageously configured for placement on a 'ground' 22 close to a ledge 24 of a drop off 26.

Typical envisioned 'grounds' 22 include without limitation:— any roofs or decks of Buildings,
the decks of Bridges,
any decks or platforms associated with Barges,
any decks or platforms associated with Flat bed trailers,
any decks or platforms associated with Observation towers/antennas,
the ground behind Retaining walls,
any decks or platforms associated with Ball stadiums,
any decks or platforms associated with Cruise ships,
the ground above Cave overhangs,
the ground above Cliffs,
any decks or platforms associated with Piers/wharves, and so on. The 'ground' 22 need not be perfectly horizontal nor perfectly level.

The drawings show for example and without limitation an amusement ride 20 in the nature of a swinging ride. The amusement ride 20 comprises a spaced pair of base mounting structures 30 secured to the 'ground' 22 close to and generally parallel to the ledge 24 of the drop off 26. The 'ground' 22 in the drawings is illustrated as (for example and without limitation) a flat roof of multi-story commercial building. The drop off 26 is the side of building. The ledge 24 is the edge of the roof. For safety purposes, the ledge 24 is guarded by a safety barrier 32 like a wall or handrail.

The base mounting structures 30 define between themselves a generally horizontal fulcrum axis 34, which otherwise might be referred to as a rocking axis 34. Each base mounting structure 30 pivotally supports a rocking boom 36. Thus there are a pair of rocking booms 36. The rocking booms 36 extend from the common rocking axis 34 therefor to distal ends 30 which are spanned by a cross bar 40 preferably serving as an axle 40. The base mounting structures 30 resemble clevis-style brackets (or alternatively, bascule-bridge style mounts) having spaced sidewalls 42 flanking the respective rocking boom 36 where the respective rocking boom 36 is pivotally supported on a spindle 44 or bearing or the like.

The amusement ride 20 includes a swinging passenger carrier 46. The passenger carrier 46 is suspended by spokes 48 from the axle 40. That is, the passenger carrier 46 is 'suspended' at rest, but is not truly 'suspended' while being driven in swinging motions. There are two spokes 48 for each of the left and right sides of the axle 40, but equivalent substitutions could include a single wedge-shaped spoke (not shown). The spokes 48 preferably are relatively stiff rather than flaccid.

The axle 40 might instead be merely a cross bar 40. The spokes 48 might preferably be flaccid and tethered to the cross bar 40 such that the cross bar 40 can be rotated and thereby winch the carrier 46 relatively closer to or further away from the cross bar 40.

The spokes 48 might be stiff or flaccid and might swing on an axis that is not coincident with the central axis of the cross bar 40 (this is not shown). The inner ends 54 of the spokes 48 might be fixed to some structures near the distal ends 56 of the booms 36 but spaced slightly away from the cross bar 40 (nor is this shown).

It is preferred however to provide a fully rotating axle 40 from which the spokes 48 are suspended, either directly or indirectly. The distal ends 56 of the booms 36 support opposed drive system housings 58. The drive system housings 58 would enclose brakes (not shown). The drive system 62 for the axle 40 turns the axle 40, preferably including in full 360° revolutions. The drive system housings 56 are stationary with the distal ends 56 of the booms 36. The preferred drive means 62 includes opposed electric motors 62, one at each end of the axle 40.

To return back to the rocking booms 36, they are driven by their own drive system 72 to tilt between angular extremes of about 9 o'clock and 3 o'clock on an imaginary clock dial.

It is an arbitrary choice, but for the sake of establishing a direction for description's sake, the 'counterclockwise' direction is chosen to signify the tilting of the booms 36 from the 12 o'clock position on the imaginary clock dial to retreat away from the ledge 24 over the 'ground' 22. The 'clockwise' direction is chosen to signify the tilting of the booms 36 from the 12 o'clock position on the imaginary clock dial to project out over into the empty space above the drop off 26. A more narrow range of preferred angular extremes for the tilting of the booms 36 might included without limitation being between 9:15 on the imaginary clock face, and, 1:30.

The drive system 72 for driving the tilt of the booms 36 is illustrated for example and without limitation to be hydraulic, comprising hydraulic cylinders. The base mounting structures 30 include stop surfaces 76 at the 'clockwise' extremes (i.e., the angular outboard extremes for the tilt booms out over the drop off, or, 1:30 on the arbitrary clock face). That way, the hydraulics 72 are relieved from having to hold a fixed position for the booms 36 in the outboard extreme position during all the dynamic forces felt or applied while the swinging carrier 46 is being rotated.

The axle 40 is rotatably supported in the drive system housings 58 by bearings or the like, and driven by any of gear, chain or pulley couplings and the like by the electric motors 62. Hence the axle 40 (or otherwise the carrier 46) is driven for motion by drive mechanics 62 which are independent of the drive mechanics 72 for the rocking booms 36. The drawings show for example and without limitation that the rocking booms 36 are driven by a hydraulic system 72, which is independent and not coupled the drive system 62 for the swinging carrier 46, which the drawings show for example and without limitation to be an electric drive system, such as by virtue of electric motors 62.

The spokes 48 preferably rotate with the axle 40, or, if the axle 40 is generally fixed to ends of the rocking booms 36, the spokes 48 preferably rotate with sleeves about the axle 40 (this is not shown). That way, the amusement ride 20 can include the provisions of counterweights 78 to counterbalance the swinging carrier 46 during swinging.

Figure 5:
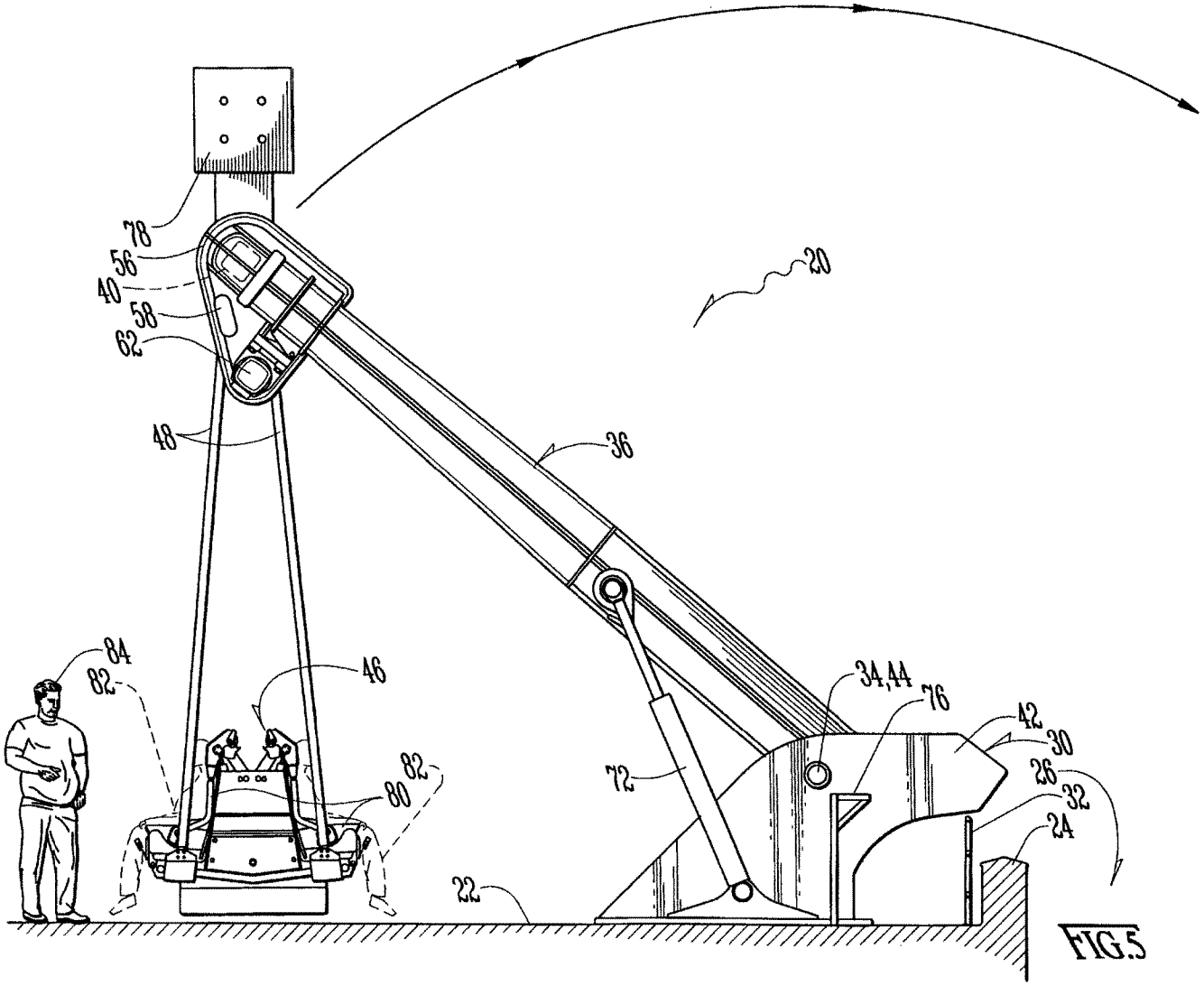
FIG. 5 is a side elevational view of comparable to FIG. 3 except showing passengers loading into the seats of the carrier.

The drawings show that the swinging carrier 46 is configured with four individual passenger seats 80. Two seats 80 face clockwise, and the other two counterclockwise. FIG. 5 shows better that, it is an aspect of the invention that the rocking booms 36 tilt 'inboard' sufficiently (e.g., counterclockwise in the example above) to allow passengers 82 to board (seat themselves in) the seats 80 the directly from the level of 'ground' 22. This eliminates the need for any steps or ladders and the like (none shown).

Figure 6:
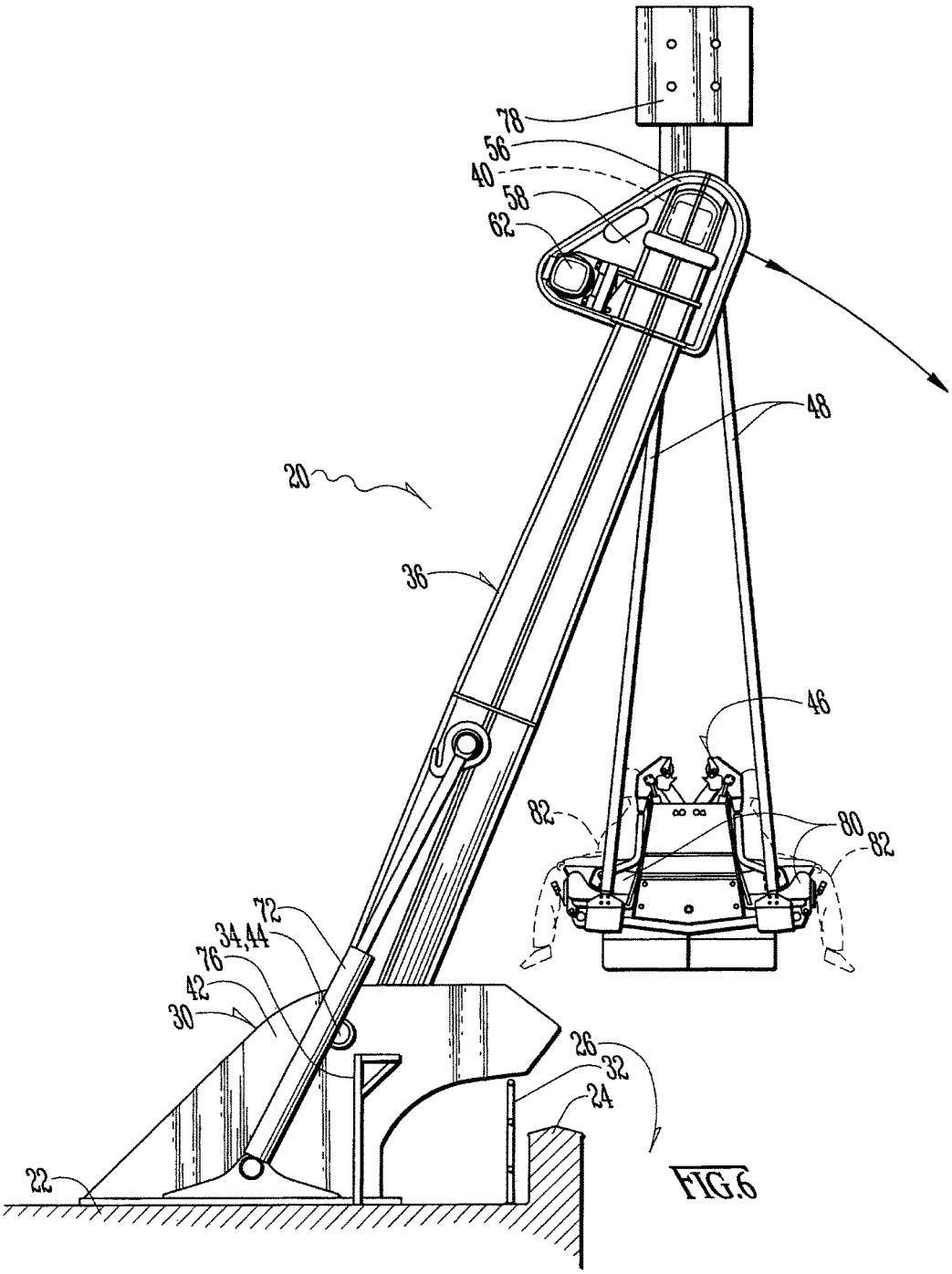
FIG. 6 is a side elevational view of comparable to FIG. 5 except showing the pair of booms in the process of pivoting toward a forward extreme tilted position therefor.
Figure 7:
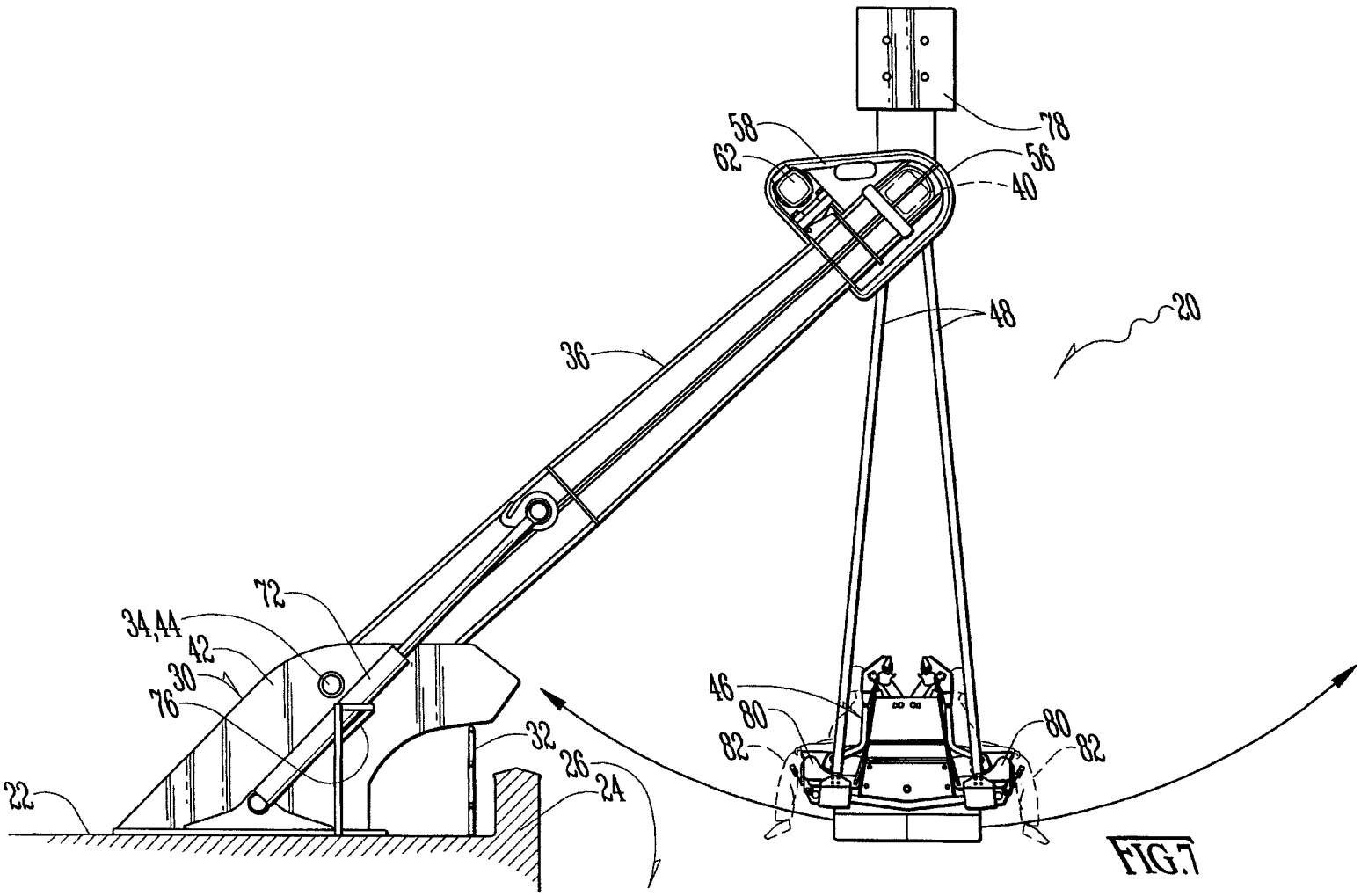
FIG. 7 is a side elevational view of comparable to FIG. 6, except in this instance showing the pair of booms pivoted and stopped at the forward extreme tilted position, and also showing the carrier swinging between acute extremes (i.e., less than 90° apart)
Figure 8:
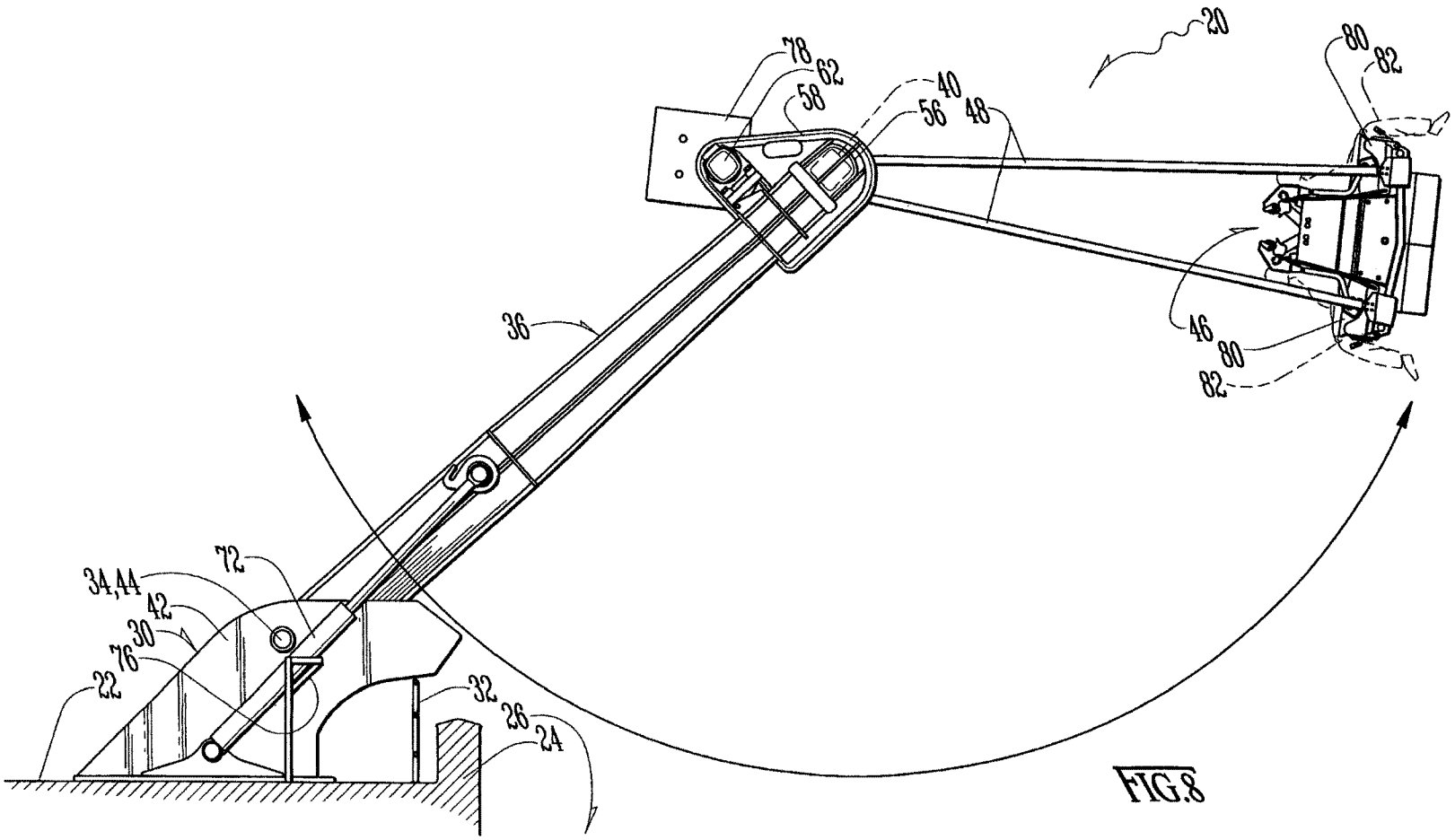
FIG. 8 is a side elevational view of comparable to FIG. 7, except showing the carrier swinging between obtuse extremes (between 180° and 90° apart)
Figure 9:
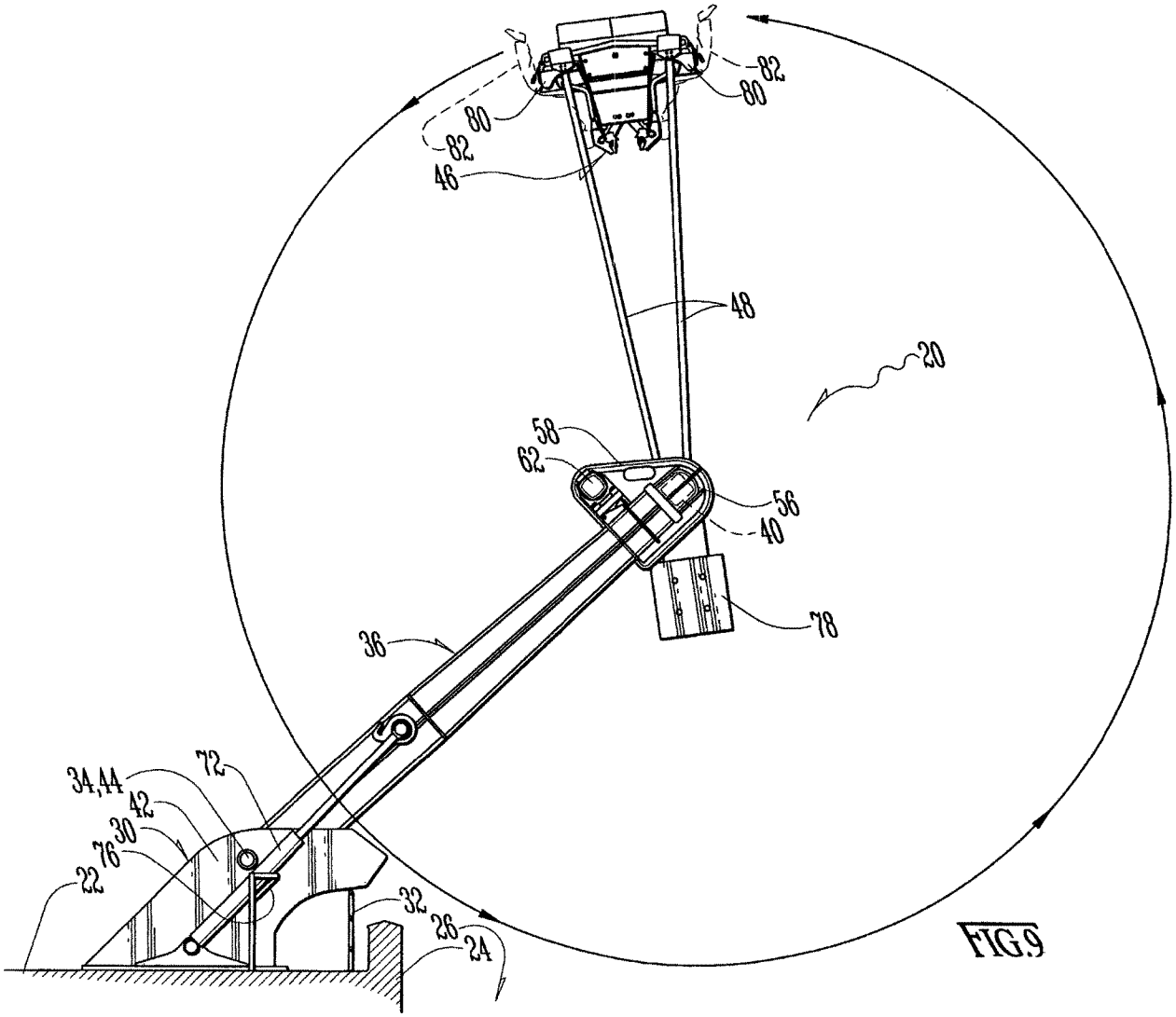
FIG. 9 is a side elevational view of comparable to FIG. 8, except showing the carrier swinging in full 360° revolutions.

FIGS. 6 and 7 show better that, it is an additional aspect of the invention to configure the rocking booms 36 (relative to spokes 48 suspending the swinging carrier 46) such that the rocking booms 36 can lift the swinging carrier 46 over the safety barrier 32 at the ledge 24 of the drop off 26, and thereafter suspend the swinging carrier 46 out into empty space past the drop off 26.

It is another aspect of the invention to provide the option of, giving ride control over to the passengers 82 rather than a ride-control operator 84. That is, it is an aspect of the invention that either (1) the passengers 82 or (2) the ride-control operator 84 can determine whether the swinging carrier 46 will rotate in full revolutions, or, between arc extremes. The choices can be varied over a range from relatively minimum to relatively maximum including without limitation any of:— acute extremes (i.e., less than 90° apart),
obtuse extremes (between 180 and 90° apart),
reflex extremes (greater than 180° apart), or
full 360° rotations.

It is another aspect of the invention to provide the swinging carrier 46 with one or more passenger seats 80 which can adapted for passengers 82 ranging between children to large adults:—for example that is, between extremes of a thirty-six inch tall, thirty-five pound child (~1 m, 16 kg), and, an immense adult, perhaps exceeding four hundred and fifty pounds (~200 kg).

Figure 10:
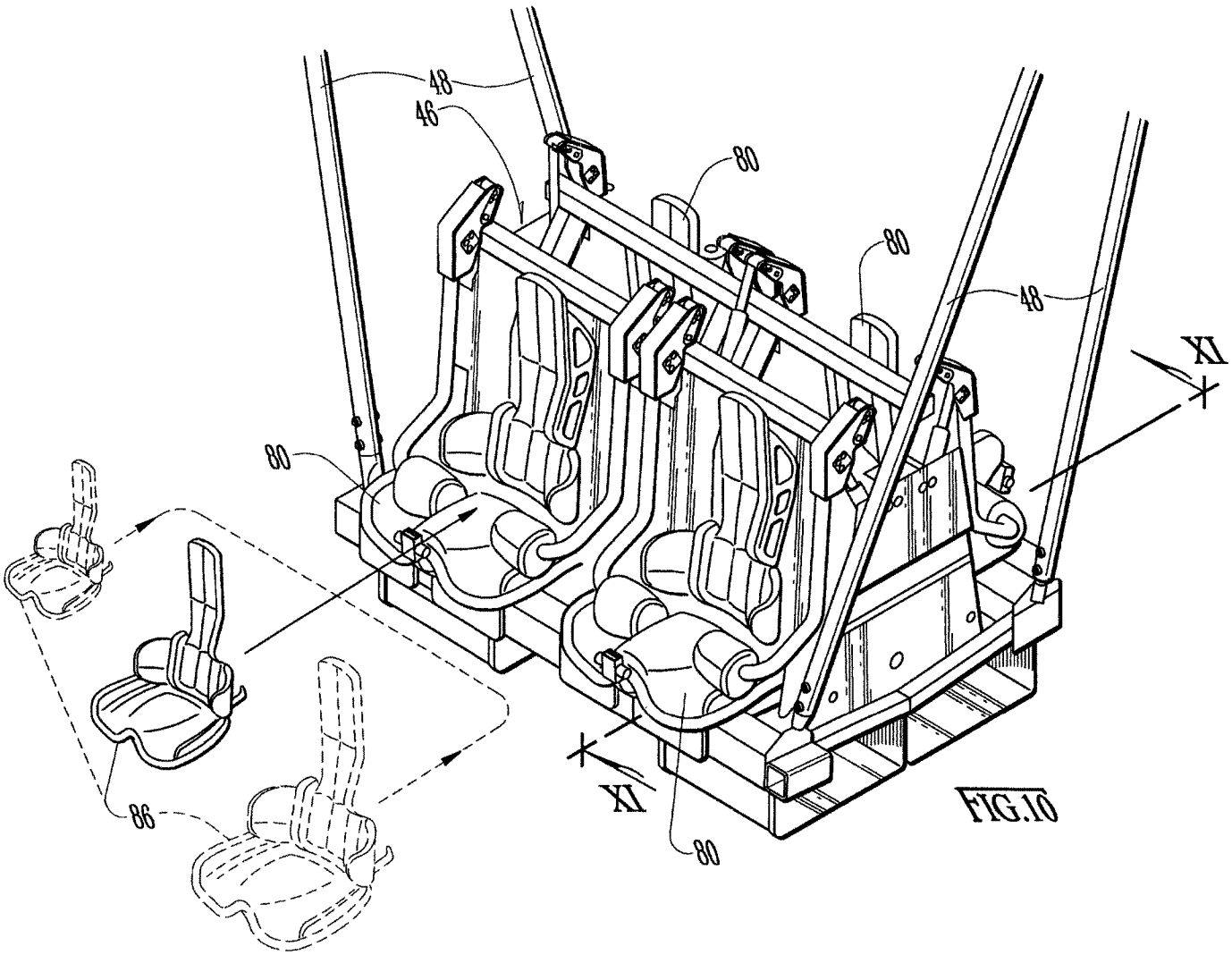
FIG. 10 is an enlarged scale perspective view of the passenger carrier of the amusement apparatus in accordance with the invention, with a hook-in insert shown explodes and which provides an effective seat sized for children.
Figure 11:
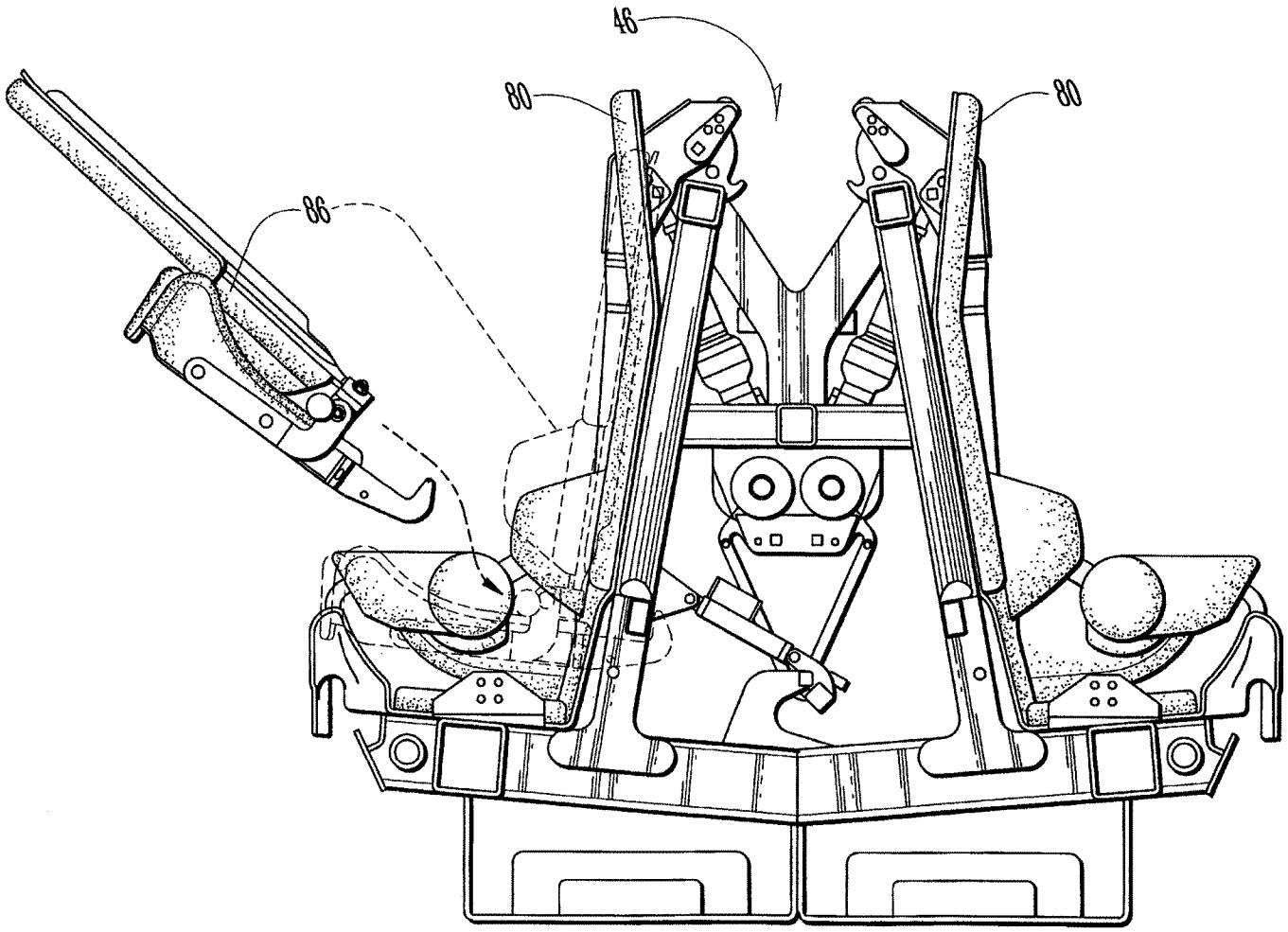
FIG. 11 is a side elevational view taken in the direction of arrows XI-XI in FIG. 10.

FIGS. 10 and 11 show the carrier 46 constructed with four seats 80 (for example and without limitation). Each seat 80 can receive a hook-in insert 86 to provide an effective seat sized for a certain range of passenger heights and weights. Preferably there are an array of different sized inserts 86 available, each designed for a target height and weight range. In effect, the smallest inserts 86 function in part as a booster seat. Such inserts 86 allow the ride 20 to be enjoyed by a wide cross-section of amusement seekers 82.

Figure 12:
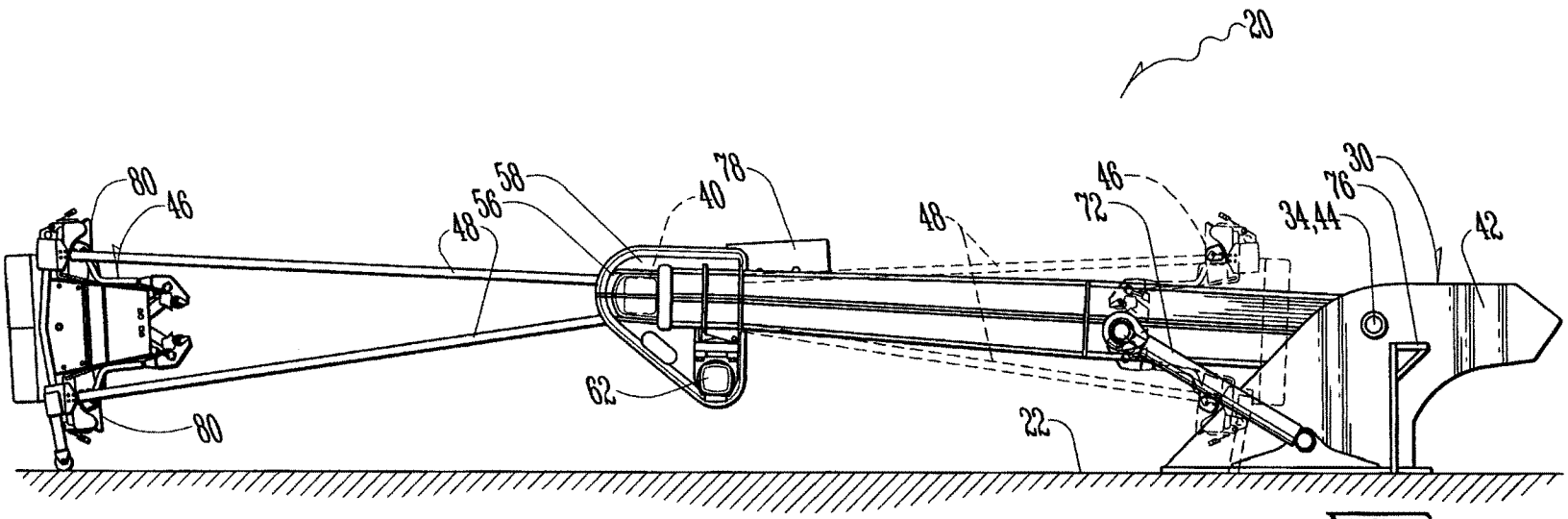
FIG. 12 is a side elevational view of comparable to FIG. 7, except showing the booms pivoted and stopped at (or nearly at) a rearward extreme tilted position.

FIG. 12 shows that the rocking booms 36 can tilted (lowered) all the way backward to land on the 'ground' 22, or at least very close to the 'ground' 22. This flexibility allows the booms 36 to be brought in closer down to the 'ground' 22 for maintenance and/or protection from extreme weather like high winds.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. An amusement ride for locating on a ground leading to a ledge of a drop off, comprising:

a pair of spaced rocking booms pivotally mounted with respect to the ground;

said amusement apparatus comprising:— a driven axle carried between the rocking booms;

a passenger carrier; and spokes extending radially away from the axle to connections with the passenger carrier; and a pair of spaced mounting blocks engaging the ground and defining a rocking axis therebetween;

said rocking booms extending between base ends and distal ends;

each mounting block pivotally supporting a respective one of the rocking booms proximate the base end thereof such that the rocking booms rock in common on the rocking axis;

each mounting block pivotally supporting the axle at spaced locations proximate a respective one of the ends of the axle;

an axle drive system for the driven axle to swing the passenger carrier in urge arcs large arcs; and a rocking boom drive system for pivoting the rocking booms between inboard and outboard extremes.

2. The amusement ride of claim 1 wherein:

the axle drive system and driven axle are configured to rotate the passenger carrier in full 360° revolutions.

3. The amusement ride of claim 1 further comprising:

said axle being elongated between spaced ends.

4. The amusement ride of claim 3 wherein:

the axle drive system and driven axle are configured to rotate the passenger carrier in 180° arcs between an outgoing extreme and an incoming extreme;

the spokes are elongated between inner and outer ends and have a length therebetween;

the rocking booms have a length between the base and distal ends thereof;

the length of the spokes is scaled relative the length of the rocking booms such that the passenger carrier does not collide with the ground.

5. The amusement ride of claim 3 wherein:

the spokes are elongated between inner and outer ends and have a length therebetween;

the rocking booms have a length between the base and distal ends thereof;

the rocking booms rock between an inboard extreme and an outboard extreme;

the length of the spokes is scaled relative the length of the rocking booms such that the passenger carrier can be rocked inboard to an extent in contact or near contact with the ground whereby passengers can board without steps of ladders.

6. The amusement ride of claim 5 wherein:

the length of the spokes is scaled relative the length of the rocking booms such that the rocking booms can be rocked to an inboard extreme such that the distal ends thereof are in contact with the ground as for maintenance or stowing safely down during inclement weather.

7. The amusement ride of claim 3, further comprising:

a safety barrier engaging the ground disposed spaced away outboard from the rocking axis;

the spokes are elongated between inner and outer ends and have a length therebetween;

the rocking booms have a length between the base and distal ends thereof;

the rocking booms rock between an inboard extreme over the ground and an outboard extreme over the safety barrier;

the length of the spokes is scaled relative the length of the rocking booms such that booms lifts the suspended non-pivoting passenger carrier over the safety barrier when rocking back and forth between inboard and outboard extremes therefor.

8. The amusement ride of claim 3, wherein:

said drive system for the rocking booms comprises hydraulics; and said drive system for the axle comprises electric motors and brakes.

9. The amusement ride of claim wherein:

said passenger carrier comprises plural bucket seats.

10. The amusement ride of claim 3 wherein:

said passenger carrier comprises plural forward-facing bucket seats and plural rearward facing bucket seats.

11. The amusement ride of claim 1 wherein:

said passenger carrier comprises plural forward-facing bucket seats and plural rearward facing bucket seats; and said amusement ride further comprising a plurality of different-sized booster seats for insertion in or over any one of the bucket seats.

12. An amusement ride for locating on a ground leading to a ledge of a drop off, comprising:

a pair of spaced elongate rocking booms extending between base ends and distal ends, pivotally mounted proximate the base ends with respect to the ground;

said amusement apparatus comprising:— a pivotal spaced pair of suspension connections carried directly or indirectly proximate the spaced distal ends of the rocking booms;

a passenger carrier; and elongate spokes extending between (1) inner ends directly or indirectly connected to the spaced suspension connections and (2) outer ends connected directly or indirectly to the passenger carrier; and a drive system for pivoting the pivotal suspension connection in large arcs to thereby swing the passenger carrier in large arcs; and a rocking boom drive system for pivoting the rocking booms between inboard and outboard extremes.

13. The amusement ride of claim 12 wherein:

the drive system for pivoting the pivotal suspension connection is configured to rotate the passenger carrier in full 360° revolutions.

14. The amusement ride of claim 12 further comprising:

a pair of spaced mounting blocks engaging the ground and defining a rocking axis therebetween;

said rocking booms extending between base ends and distal ends;

each mounting block pivotally supporting a respective one of the rocking booms proximate the base end thereof such that the rocking booms rock in common on the rocking axis;

a safety barrier engaging the ground disposed spaced away outboard from the rocking axis.

15. The amusement ride of claim 14 wherein:

the drive system for pivoting the pivotal suspension connection is configured to rotate the passenger carrier in 180° arcs between an outgoing extreme and an incoming extreme;

the spokes have a length therebetween the inner and outer ends thereof;

the rocking booms have a length between the base and distal ends thereof;

the length of the spokes is scaled relative the length of the rocking booms such that the passenger carrier does not collide with the safety barrier at the incoming extreme.

16. The amusement ride of claim 14 wherein:

the spokes have a length therebetween the inner and outer ends thereof;

the rocking booms have a length between the base and distal ends thereof;

the rocking booms rock between an inboard extreme over the ground and an outboard extreme over the safety barrier;

the length of the spokes is scaled relative the length of the reeking rocking booms such that the passenger carrier can be rocked inboard to an extent in contact or near contact with the ground whereby passengers can board without steps of ladders.

17. The amusement ride of claim 16 wherein:

the length of the spokes is scaled relative the length of the rocking booms such that the rocking booms can be rocked to an inboard extreme such that the distal ends thereof are in contact with the ground as for maintenance or stowing safely down during inclement weather.

18. The amusement ride of claim 14, further comprising:

the spokes have a length therebetween the inner and outer ends thereof;

the rocking booms have a length between the base and distal ends thereof;

the rocking booms rock between an inboard extreme over the ground and an outboard extreme over the safety barrier;

the length of the spokes is scaled relative the length of the rocking booms such that booms lifts the suspended non-pivoting passenger carrier over the safety barrier when rocking back and forth between inboard and outboard extremes therefor.

19. The amusement ride of claim 14 wherein:

said passenger carrier comprises plural forward-facing bucket seats and plural rearward facing bucket seats.

20. The amusement ride of claim 12 wherein:

said passenger carrier comprises plural forward-facing bucket seats and plural rearward facing bucket seats; and said amusement ride further comprising a plurality of different-sized booster seats for insertion in or over any one of the bucket seats.

* * * * *